US005174736A

United States Patent [19]

Hirano et al.

[11] Patent Number: 5,174,736

[45] Date of Patent: Dec. 29, 1992

[54] SCROLL-TYPE COMPRESSOR WITH COVER MEMBER FOR SUCTION AND DISCHARGE CAVITIES

[75] Inventors: Takahisa Hirano, Nagoya; Takayuki Iio, Nishikasugai, both of Japan

[73] Assignee: Mitsubishi Jukogyo Kabushiki Kaisha, Tokyo, Japan

[21] Appl. No.: 719,262

[22] Filed: Jun. 21, 1991

[30] Foreign Application Priority Data

Jul. 16, 1990 [JP] Japan ..... 2-187704

[51] Int. Cl.[5] ..... F04C 18/04

[52] U.S. Cl. ..... 418/55.1; 418/55.4; 418/270

[58] Field of Search ..... 418/55.1, 270, 55.4; 417/571

[56] References Cited

U.S. PATENT DOCUMENTS

| | | | |
|---|---|---|---|
| 1,638,114 | 8/1927 | Dunlap et al. | 417/571 |
| 2,650,545 | 9/1953 | Cornelius | 417/571 |
| 4,314,796 | 2/1982 | Terauchi | 418/55.1 |
| 4,502,854 | 3/1985 | Shibuya et al. | 418/15 |
| 4,536,139 | 8/1985 | Greco et al. | 417/571 |
| 4,571,163 | 2/1986 | Sakamoto et al. | 418/55.1 |

FOREIGN PATENT DOCUMENTS

| | | | |
|---|---|---|---|
| 0069531 | 1/1983 | European Pat. Off. . | |
| 53-103209 | 9/1978 | Japan | 417/571 |
| 82/03429 | 10/1982 | PCT Int'l Appl. . | |
| 2107790 | 5/1983 | United Kingdom . | |

*Primary Examiner*—John J. Vrablik

*Attorney, Agent, or Firm*—McAulay, Fisher, Nissen, Goldberg & Kiel

[57] ABSTRACT

A compressor is composed of a housing equipped with a compression mechanism portion and a cover body having a fitting portion. The housing has a suction cavity communicating with a suction chamber and a discharge cavity communicating with a discharge chamber on a peripheral surface thereof. The suction cavity and the discharge cavity are closed up tightly by fitting the cover body to the housing, and the fitting portion is made to communicate with the suction cavity and the discharge cavity, respectively.

6 Claims, 5 Drawing Sheets

SCROLL-TYPE COMPRESSOR WITH COVER MEMBER FOR SUCTION AND DISCHARGE CAVITIES

FIELD OF THE INVENTION AND RELATED ART STATEMENT

The present invention relates to a compressor, and more particularly to a compressor for a car cooler which is installed on an engine.

A compressor for a car cooler is fastened to an engine usually with bolts and the like, and is driven together with an alternator, a cooling water pump and the like through a V belt which is wound around a pulley fixed at one end of a crank shaft of the engine.

Besides, a car cooler is mounted at user's wish. Accordingly, a compressor for a car cooler is installed on an engine after completion of a motor car, and a refrigerant piping is connected with this compressor.

Now, in case a car type is different, a layout of an engine, a configuration of an engine and the like are also different. Therefore, the compressor is restricted seriously in points of installing position on the engine and posture, and is also subject to restriction in points of position and direction of a fitting portion with which the refrigerant piping is connected.

In order to cope with such situation, housings having configurations corresponding to respective engines on which a compressor is installed has been heretofore prepared in a compressor of this type, thus giving rise to a problem of adding to a cost.

OBJECT AND SUMMARY OF THE INVENTION

It is an object of the present invention to provide a compressor in which reduction of cost is aimed at by using a principal part of a housing in common.

According to the present invention which has been made to achieve above-mentioned object, there is provided a compressor characterized in that a suction cavity communicating with a suction chamber and a discharge cavity communicating with a discharge chamber are formed in one body while having those cavities be adjacent to each other across a partition wall on an outer periphery of a housing, and a fitting portion where a suction piping and a discharge piping are connected with a cover member which is fitted detachably to a flange which surrounds above-mentioned suction cavity and discharge cavity and closes up above-mentioned suction cavity and discharge cavity tightly is provided.

In the present invention, it is possible to alter the connecting position and the direction of the suction piping and the delivery piping by exchanging the cover member only.

As a result, it becomes no longer necessary to prepare variety of housings in accordance with the engine, being different from a conventional compressor. Hence, the cost may be reduced by a large margin.

DETAILED DESCRIPTION OF THE PREFERRED EMBODIMENTS

FIG. 1 thru FIG. 6 show an embodiment of the present invention.

Figure 1:
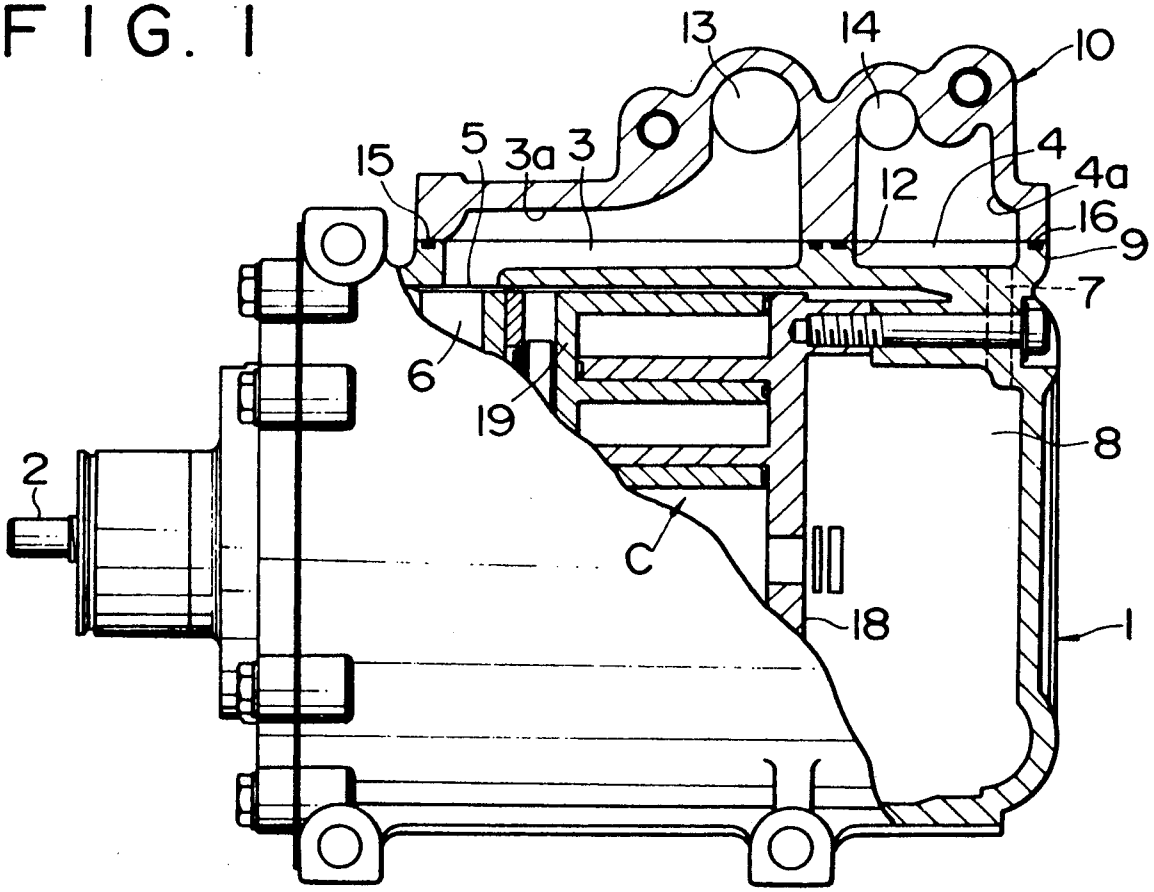
FIG. 1 is a front view showing a partial section taken along a line I—I in FIG. 2.
Figure 2:
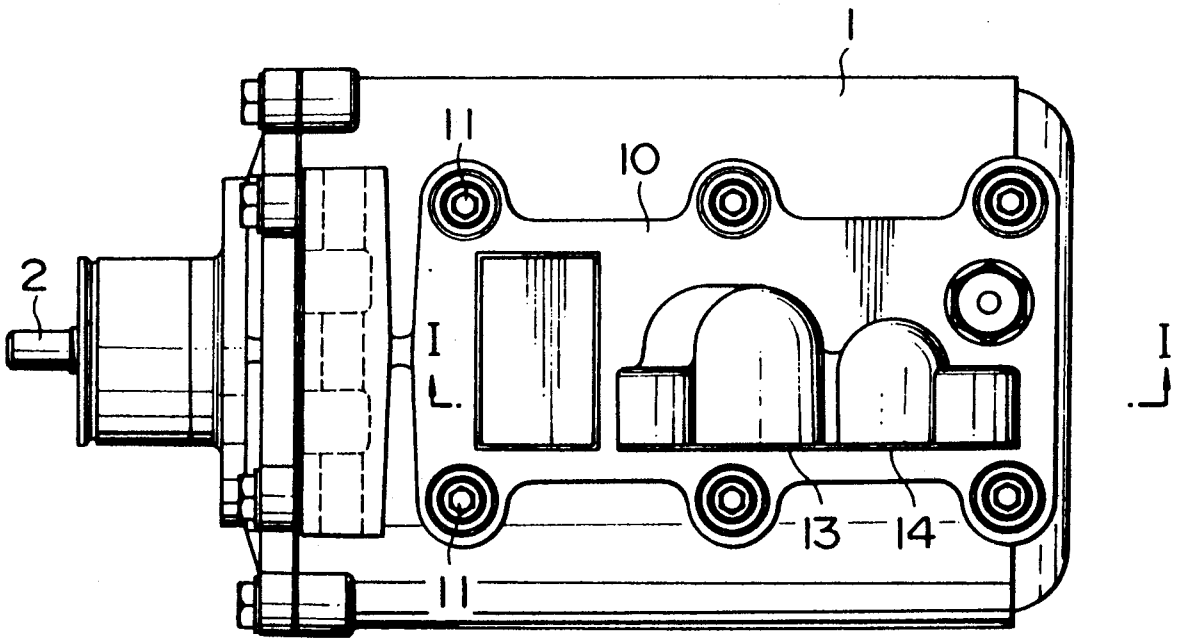
FIG. 2 is a top view.

A scroll compression mechanism C consisting of a stationary scroll 18, a revolving scroll 19 and the like is self-contained inside a housing 1 as shown in FIG. 1, and refrigerant gas is compressed by driving the revolving scroll 19 through a rotary shaft 2.

Figure 3:
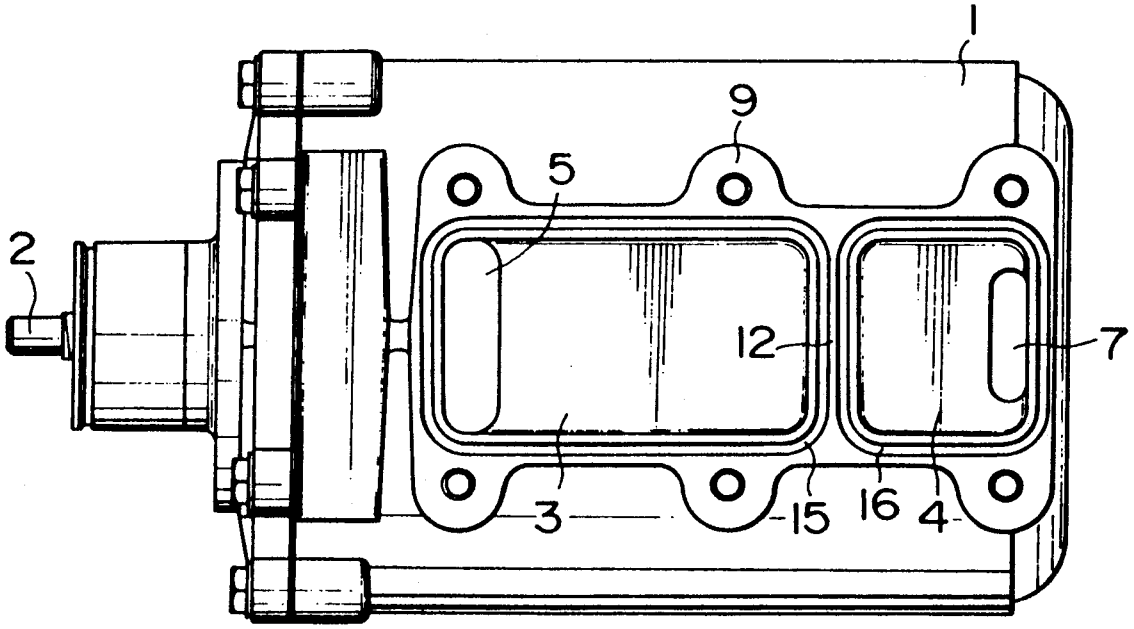
FIG. 3 is a top view showing a state in which a cover member has been removed.
Figure 4:
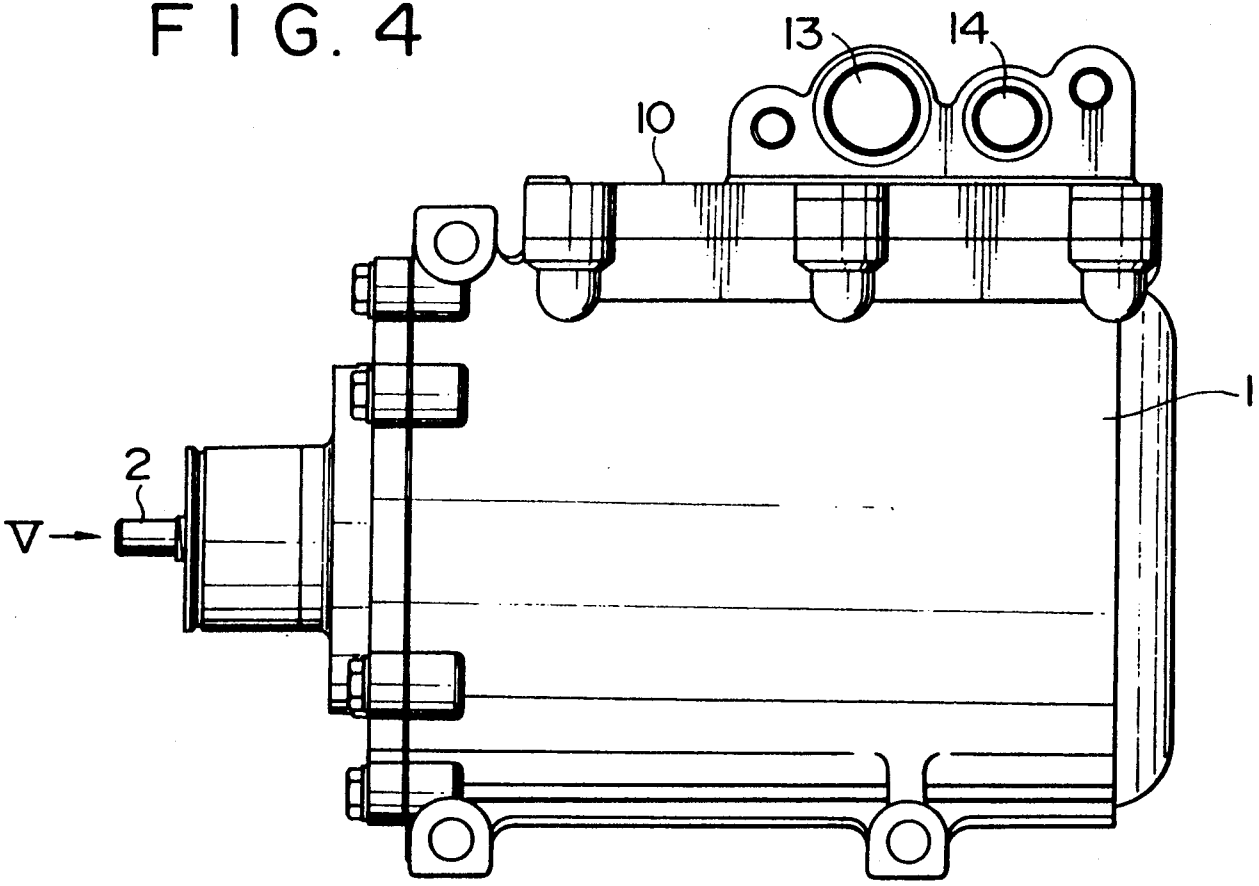
FIG. 4 is a front view.

A suction cavity 3 and a discharge cavity 4 are formed in one body while being adjacent to each other across a partition wall 12 on an outer periphery of the housing 1 as shown in FIG. 1 and FIG. 3. The suction cavity 3 communicates with a suction chamber 6 through a communication hole 5, and the discharge cavity 4 communicates with a discharge chamber 8 through a communication hole 7. A flange wall 9 is set up so as to surround the suction cavity 3 and the discharge cavity 4 in the housing 1 as shown in FIG. 3, and the suction cavity 3 and the discharge cavity 4 are closed up tightly between a cover member 10 and the housing 1 by fastening the cover member 10 to the flange wall 9 by means of a plurality of (6 pieces in FIG. 2) bolts 11. A suction fitting 13 with which a suction piping is connected and a discharge fitting 14 with which a discharge piping is connected are formed in the cover member 10. Further, as shown in FIG. 1, the suction fitting 13 communicates with the suction cavity 3 and the discharge fitting 14 communicates with the discharge cavity 4.

An oil seal 15 which surrounds the suction cavity 3 and an oil seal 16 which surrounds the discharge cavity 4 are buried in an end surface of the flange wall 9 as shown in FIG. 1 and FIG. 3, and these oil seals 15 and 16 are in close contact with the end surface of the cover member 10, thereby to prevent gas leakage.

Figure 5:
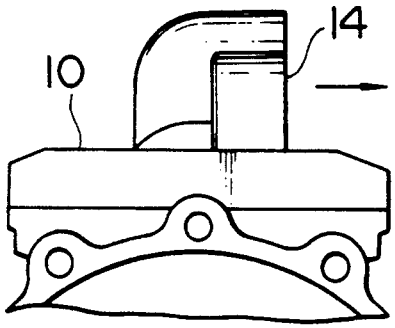
FIG. 5 is a partial side view taken along an arrow mark V in FIG. 4.
Figure 6:
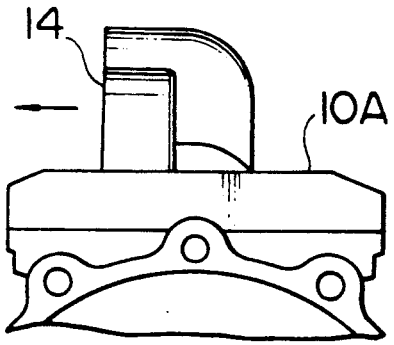
FIG. 6 is a side view corresponding to FIG. 5 in case a different cover member is installed.

As shown in FIG. 5, it is possible to connect the suction piping and the discharge piping from the front (right side seeing from the front of the compressor), respectively, when the cover member 10 in which fittings 13 and 14 are formed so as to face the front (a direction perpendicular to the shaft) is fitted to the flange wall 9. However, when a cover member 10A in which fittings 13 and 14 are formed so as to face the back (another direction perpendicular to the shaft), respectively, is fitted to the flange wall 9 as shown in FIG. 6, it is possible to connect the suction piping and the discharge piping from the back (left side seeing from the front of the compressor), respectively.

Since the suction cavity 3 and the discharge cavity 4 are formed adjacent to each other, these cavities can be closed up by a single action by means of one piece of cover member 10.

Further, when a recessed portion 3*a* which conforms to the suction cavity 3 and a recessed portion which conforms to the discharge cavity 4 are formed inside the cover member 10 as shown in FIG. 1, it is possible to increase the volume of the suction cavity 3 and the discharge cavity 4 and also to have them function as a muffler.

Besides, when a plurality of types of cover members having positions and directions of the fittings 13 and 14 altered in accordance with the type of engine equipped with a compressor are prepared, the suction piping and the discharge piping can be connected at any position and from any direction by exchanging the cover member.

In above-mentioned embodiment, the cover member 10 is fitted to the upper part of the housing 1, but it is also possible to arrange so that it may be fitted to any portion, viz., the lower portion, the side portion and the end portion of the housing 1 and so forth. Further, when the suction cavity 3 and the discharge cavity 4 are formed point-symmetrically or linear-symmetrically, it is possible to alter positions and directions of the suction fitting 13 and the discharge fitting 14 of the cover member 10 by 180° by installing the cover member 10A after altering the direction by 180°.

We claim:

1. A scroll-type compressor comprising:

a housing having a suction chamber, a discharge chamber, a rotary shaft and a flange wall;

a stationary scroll and a revolving scroll mounted within said housing, said revolving scroll being driven by said rotary shaft;

said flange wall constituting an outer surface of said housing and defining therein a suction cavity and a discharge cavity, said suction and discharge cavities being disposed closely adjacent one another and separated by a partition wall;

said suction cavity being in communication with said suction chamber, and said discharge cavity being in communication with said discharge chamber;

the outer surface of said housing formed by said flange wall defining a planar surface;

a cover member removably mounted to said flange wall to enclose said suction and discharge cavities;

said cover member having a suction port and a discharge port disposed adjacent one another and projecting outwardly therefrom in the same direction;

said suction port being in communication with said suction cavity, and said discharge port being in communication with said discharge cavity; and said suction port and said discharge port projecting in a direction substantially transverse to the axis of said rotary shaft and substantially parallel to the planar surface of said flange wall.

2. The scroll-type compressor of claim 1, wherein said suction port and said discharge port each have an axis, and wherein the axes of said suction and discharge ports define a plane substantially parallel to the axis of said rotary shaft and substantially parallel to the planar surface of said flange wall.

3. The scroll-type compressor of claim 1, wherein said cover member includes first and second laterally spaced recessed portions, said first recessed portion communicating with said suction cavity and said suction port, and said second recessed portion communicating with said discharge cavity and said discharge port.

4. The scroll-type compressor of claim 2, wherein said cover member includes first and second laterally spaced recessed portions, said first recessed portion communicating with said suction cavity and said suction port, and said second recessed portion communicating with said discharge cavity and said discharge port.

5. The scroll-type compressor of claim 1, further comprising an alternate cover member removably mounted to said flange wall in place of said first mentioned cover member, said alternate cover member having a suction port and a discharge port projecting outwardly therefrom in the same direction, said direction being 180° opposite from the direction of projection of the corresponding ports of said first mentioned cover member.

6. The scroll-type compressor of claim 2, further comprising an alternate cover member removably mounted to said flange wall in place of said first mentioned cover member, said alternate cover member having a suction port and a discharge port projecting outwardly therefrom in the same direction, said direction being 180° opposite from the direction of projection of the corresponding ports of said first mentioned cover member.

* * * * *